US010380885B2

(12) United States Patent
Biehle et al.

(10) Patent No.: US 10,380,885 B2
(45) Date of Patent: Aug. 13, 2019

(54) DEVICE, METHOD, AND COMPUTER PROGRAM FOR PROVIDING TRAFFIC JAM INFORMATION VIA A VEHICLE-TO-VEHICLE INTERFACE

(71) Applicant: VOLKSWAGEN AKTIENGESELLSCHAFT, Wolfsburg (DE)

(72) Inventors: Thomas Biehle, Groß Oesingen (DE); Holger Schultz, Falkensee (DE)

(73) Assignee: VOLKSWAGEN AKTIENGESELLSCHAFT (DE)

( * ) Notice: Subject to any disclaimer, the term of this patent is extended or adjusted under 35 U.S.C. 154(b) by 0 days.

(21) Appl. No.: 15/758,950

(22) PCT Filed: May 26, 2016

(86) PCT No.: PCT/EP2016/061919
§ 371 (c)(1),
(2) Date: Mar. 9, 2018

(87) PCT Pub. No.: WO2017/045780
PCT Pub. Date: Mar. 23, 2017

(65) Prior Publication Data
US 2019/0043347 A1 Feb. 7, 2019

(30) Foreign Application Priority Data
Sep. 17, 2015 (DE) ..... 10 2015 217 793

(51) Int. Cl.
*G08B 21/00* (2006.01)
*G08G 1/01* (2006.01)
(Continued)

(52) U.S. Cl.
CPC ..... *G08G 1/0112* (2013.01); *G08G 1/0133* (2013.01); *G08G 1/0141* (2013.01);
(Continued)

(58) Field of Classification Search
CPC .. G08G 1/0112; G08G 1/0133; G08G 1/0141; G08G 1/096791
(Continued)

(56) References Cited

U.S. PATENT DOCUMENTS 5,999,877 A * 12/1999 Takahashi ..... G06K 9/00785 340/905
2006/0055565 A1* 3/2006 Kawamata ..... B60R 11/04 340/995.13
2011/0060496 A1* 3/2011 Nielsen ..... G06Q 10/0631 701/31.4
2013/0158821 A1 6/2013 Ricci
2013/0279695 A1* 10/2013 Rubin ..... G08G 9/02 380/255
(Continued)

FOREIGN PATENT DOCUMENTS

DE 19909276 A1 9/2000
DE 102010021663 A1 1/2011
(Continued)

OTHER PUBLICATIONS

Search Report for German Patent Application No. 10 2015 217 793.9, dated Jun. 21, 2016.
(Continued)

*Primary Examiner* — Mark S Rushing
(74) *Attorney, Agent, or Firm* — Barnes & Thornburg LLP

(57) ABSTRACT

Devices, methods, and computer programs for providing traffic jam information via a vehicle-to-vehicle interface. The device for a transportation vehicle includes a device for obtaining traffic jam indicators. The traffic jam indicators include at least one element of the group consisting of the speed of the transportation vehicle or of transportation vehicles in an area surrounding the transportation vehicle and a traffic jam warning. The device also includes a device
(Continued)

for determining traffic jam information based on the traffic jam indicators. The traffic jam information indicates whether the transportation vehicle is located in a traffic jam. The device also includes a vehicle-to-vehicle interface to provide the traffic jam information to one or more additional transportation vehicles via a vehicle-to-vehicle communication connection.

33 Claims, 4 Drawing Sheets

(51) Int. Cl.
*G08G 1/0965* (2006.01)
*G08G 1/0967* (2006.01)
*G08G 1/16* (2006.01)

(52) U.S. Cl.
CPC ..... *G08G 1/0965* (2013.01); *G08G 1/096716* (2013.01); *G08G 1/096758* (2013.01); *G08G 1/096775* (2013.01); *G08G 1/096791* (2013.01); *G08G 1/162* (2013.01); *G08G 1/163* (2013.01)

(58) Field of Classification Search
USPC ..... 340/905
See application file for complete search history.

(56) References Cited

U.S. PATENT DOCUMENTS

| | | | | |
|---|---|---|---|---|
| 2014/0226567 | A1 | 8/2014 | Sakata | |
| 2014/0288811 | A1* | 9/2014 | Oura | G08G 1/0116 701/119 |
| 2015/0178247 | A1* | 6/2015 | Kinoshita | G08G 1/017 702/179 |

FOREIGN PATENT DOCUMENTS

| | | | |
|---|---|---|---|
| DE | 102009047097 | A1 | 5/2011 |
| DE | 102011009601 | A1 | 8/2012 |
| DE | 102012024166 | A1 | 7/2013 |
| DE | 102012204098 | A1 | 9/2013 |
| WO | 2013135535 | A1 | 9/2013 |

OTHER PUBLICATIONS

Search Report for International Patent Application No. PCT/EP2016/061919, dated Jul. 8, 2016.

* cited by examiner

DEVICE, METHOD, AND COMPUTER PROGRAM FOR PROVIDING TRAFFIC JAM INFORMATION VIA A VEHICLE-TO-VEHICLE INTERFACE

PRIORITY CLAIM

This patent application is a U.S. National Phase of International Patent Application No. PCT/EP2016/061919, filed 26 May 2016, which claims priority to German Patent Application No. 10 2015 217 793.9, filed 17 Sep. 2015, the disclosures of which are incorporated herein by reference in their entireties.

SUMMARY

Exemplary embodiments relate to devices, methods and computer programs for providing traffic jam information via a vehicle-to-vehicle interface.

BRIEF DESCRIPTION OF THE DRAWINGS

Disclosed embodiments are described in further detail below with respect to the drawings, to which exemplary embodiments are not generally limited, however. Shown are.

DETAILED DESCRIPTION

Figure 1:
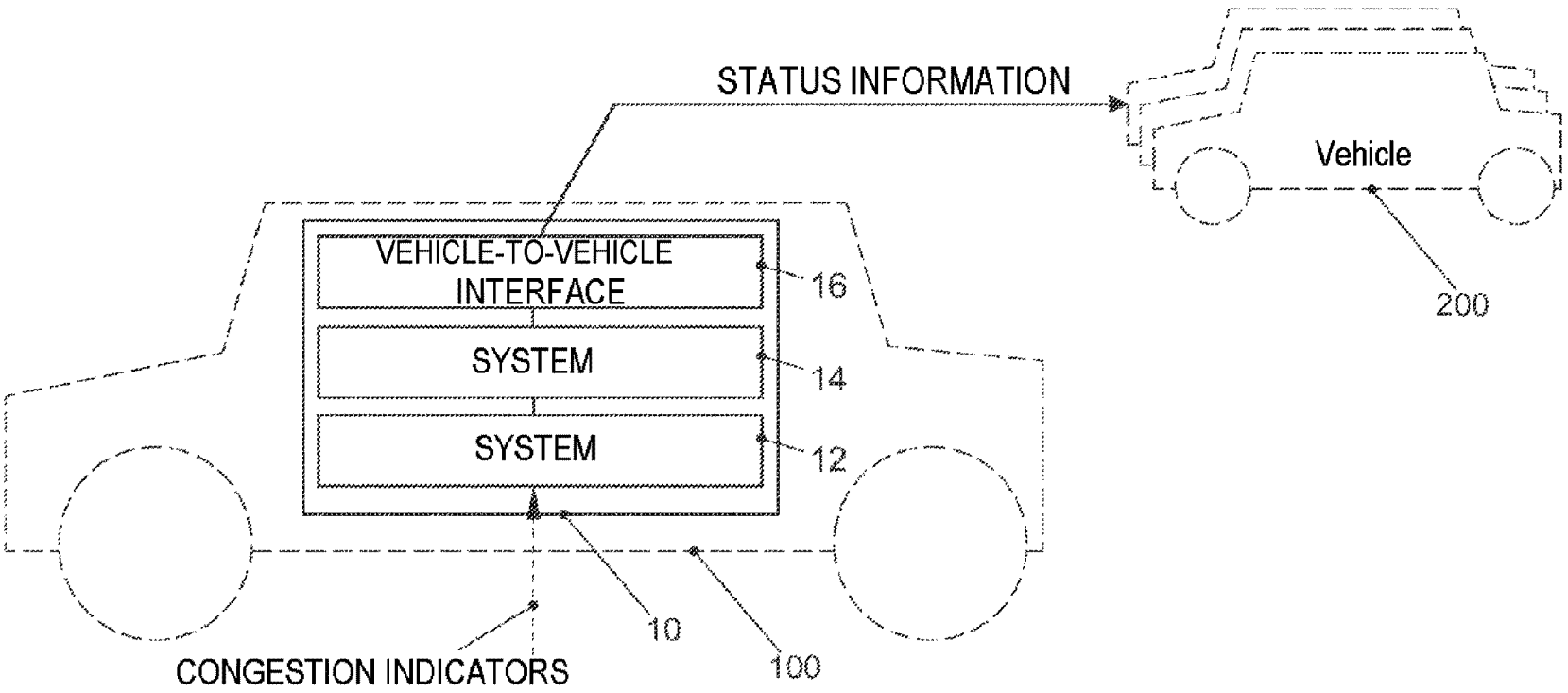
FIG. 1 illustrates a block diagram of an exemplary embodiment of a device for a transportation vehicle for providing congestion information.

Vehicle-to-vehicle communication (also Car2Car, C2C, or Vehicle2Vehicle, V2V) and vehicle-to-infrastructure communication (also Car2Infrastructure, C2I or Vehicle2Roadside, V2R) are a focal point of automotive research in the 21st century. The communication between transportation vehicles or between transportation vehicles or transport infrastructure allows a multitude of novel possibilities, such as a co-ordination between transportation vehicles or a communication of transportation vehicles with the transport infrastructure, for example, to provide traffic jam warnings to the transportation vehicles. In this situation, the transportation vehicles which are designed for C2C or C2I (also grouped together under vehicle-to-X communication, Car2X, C2X or vehicle2X, V2X) have a transmitting and receiving unit to be able to communicate with other transportation vehicles, for example, via direct radio connections or mobile radio networks. Such communication can be limited, for example, between transportation vehicles or between transportation vehicles and transport infrastructure within a radius of a few hundred meters. The communication between transportation vehicles via C2C or C2I can take place in encrypted form, and it can be secured using certificates, for example, via long-duration certificates (Long Term Certificates, LTC) or with pseudonymous certificates having only limited periods of validity (Pseudonym Certificates, PC).

Driving of a transportation vehicle in road traffic depends on many factors—for example, on the route navigation, traffic lights, obstacles but also especially on other road users, which are travelling on the same, often multi-lane road. Dangerous driving situations often occur, for example, because a hazardous situation occurs at a location with poor visibility.

A need therefore exists to provide an improved concept, to defuse dangerous driving situations and to improve driving safety for the participating transportation vehicles.

Exemplary embodiments can achieve this by determining and deploying traffic jam information. A device for a transportation vehicle can be designed in accordance with exemplary embodiments, to determine based on congestion indicators whether the transportation vehicle is in a traffic jam. These traffic jam indicators can be based, for example, on a speed of the transportation vehicle (is the transportation vehicle stopped? is there traffic congestion?), on a speed of other transportation vehicles in the surrounding area (are transportation vehicles in the surrounding area stationary? what is the average speed of the other transportation vehicles?) or on congestion warnings of other transportation vehicles or central systems, for example, congestion warning systems. These traffic congestion indicators can be combined to increase a probability that the analysis detects a traffic jam, and the congestion information can then be provided to other transportation vehicles, for example, periodically via a vehicle-to-vehicle-interface, for example, periodically as part of a Cooperative Awareness Message (CAM, periodic message, which is provided via vehicle-to-vehicle communication, and transmits a status of the transportation vehicle to other transportation vehicles) or on an event-driven basis as so-called Decentralized Environmental Notification Messages (DENM), so that, for example, it can be displayed by the other transportation vehicles as a warning.

Exemplary embodiments create a device for a transportation vehicle. The device comprises a system for obtaining traffic jam indicators. The traffic jam indicators comprise at least one element of the group of speed of the transportation vehicle or of transportation vehicles in an area surrounding the transportation vehicle, and traffic jam warning. The device also includes a system for determining traffic jam information based on the congestion indicators. The congestion information indicates whether the transportation vehicle is in a traffic jam. The device also comprises a vehicle-to-vehicle interface designed to provide the traffic jam information to one or more other transportation vehicles via a vehicle-to-vehicle communication link. Other transportation vehicles that have obtained the congestion information via a vehicle-to-vehicle interface can use the congestion information, for example, to increase driving safety, for example, by the display of warnings. The use of congestion indicators for the calculation can increase a probability or accuracy of the calculation and can facilitate model- and manufacturer-independent standards for determining whether a transportation vehicle is stuck in a traffic jam. The provision of the congestion information via the vehicle-to-vehicle-interface can also, for example, reduce a delay in the transmission of the congestion information compared to a centralized solution. The provision of the traffic jam information can also increase driving safety.

In some embodiments, the system for obtaining the traffic jam indicators can be designed to obtain the congestion warning via a vehicle-to-infrastructure communication link, a vehicle-to-vehicle communication link, or via a mobile communication system. Obtaining the congestion warning via a vehicle-to-vehicle communication link or a vehicle-to-infrastructure communication link can reduce a delay in the transmission of the traffic jam warning or increase the currentness of the information compared to a mobile communication system. Receiving the congestion warning via the mobile communication system can facilitate the subsequent use of centrally collected or processed data, which can be based, for example, on many different indicators.

In some exemplary embodiments, the system for obtaining the congestion warnings can be designed to obtain the congestion warning using a Decentralized Environmental Notification Message, DENM, via the vehicle-to-vehicle interface. Obtaining a congestion warning via an event-based DENM message can increase a currentness of the congestion warning.

In at least some exemplary embodiments the system for obtaining the congestion warnings can be designed to obtain the speed of the transportation vehicles in an area surrounding the transportation vehicle via a video sensor or a time-of-flight sensor. The use of a local sensor can enable detection of the speed of transportation vehicles that do not have a vehicle-to-vehicle interface. In at least some exemplary embodiments the system for obtaining the congestion warnings can be designed to obtain the speed of the transportation vehicles in an area surrounding the transportation vehicle via the vehicle-to-vehicle interface. Receiving the speed over the vehicle-to-vehicle interface can enable a higher accuracy of the obtained speed.

In at least some exemplary embodiments the system for obtaining the congestion warnings can be designed to obtain the speed of the transportation vehicles in an area surrounding the transportation vehicle using Cooperative Awareness Messages, CAM, via the vehicle-to-vehicle interface. Receiving the speed over the vehicle-to-vehicle interface can enable a higher accuracy of the obtained speed. The use of the CAM can enable reception of the speed without additional effort on the part of the transmitting transportation vehicles.

In at least some embodiments the system for determining the congestion information can be designed to detect that the transportation vehicle is located in a traffic jam, if an average speed of the transportation vehicle during a measurement period is above a lower threshold value and below an upper threshold value. This allows, for example, heavily congested traffic or stop-and-go driving to be detected.

In at least some exemplary embodiments the system for detecting the traffic jam information can be designed to detect that transportation vehicle is in a traffic jam, if the transportation vehicle is stationary during a measurement period, and another traffic jam indicator indicates a traffic jam. This allows, for example, a standstill in the traffic jam to be detected, wherein based on the other congestion indicator a traffic light or intersection situation, which can also generate a standstill, is in some disclosed embodiments not detected as a traffic jam.

In some disclosed embodiments, the system for determining the congestion information can be designed to detect that the transportation vehicle is located in a traffic jam if the transportation vehicle is stationary during a measurement period, and wherein the system has obtained a traffic jam warning via the system for obtaining the congestion indicators, and/or wherein an average speed of transportation vehicles in an area surrounding the transportation vehicle (100) is below an upper threshold value. This allows, for example, a standstill in a traffic jam to be detected, wherein based on receiving the congestion warning or receiving the average speed of the transportation vehicles in the area surrounding the transportation vehicle, a traffic light or intersection situation which can also generate a standstill is in some disclosed embodiments not detected as a traffic jam.

In some exemplary embodiments, the duration of the measurement period is between 60 s and 300 s. The lower threshold value can be between 3 and 10 km/h. The upper threshold value can be between 20 and 40 km/h. The use of the threshold values can enable, for example, a reproducible, transferable or standardized determination of a traffic jam.

In some exemplary embodiments, the vehicle-to-vehicle interface can also be designed for vehicle-to-infrastructure communication. This allows the device to obtain, for example, traffic jam warnings from a transport infrastructure, or enables a transfer of the congestion information to the transport infrastructure, for example, for a coordinated provision of an extent of a traffic jam.

In some exemplary embodiments, the system for determining the congestion information can be designed to also provide the congestion information to a transport infrastructure over the vehicle-to-vehicle-interface. The forwarding of the congestion information to the transport infrastructure can be used, for example, for a coordinated determination of an extent of a traffic jam.

In some exemplary embodiments, the system for determining the traffic jam information can be designed to provide the traffic jam information as a Cooperative Awareness Message, CAM, via the vehicle-to-vehicle interface. The provision of the congestion information using CAM can use, for example, the available messages and enable an exhaustive area-based periodic provision of the congestion information with a low latency.

In at least some exemplary embodiments, the system for obtaining the congestion indicators can comprise a sensor module and/or an input interface. The use of a sensor module can, for example, enable a detection of transportation vehicles which are not equipped with a vehicle-to-vehicle interface. The input interface can enable the collection of congestion indicators from other modules or entities. The system for determining the congestion information can comprise a calculation module and/or be equivalent to a calculation module. The calculation module can, for example, compare the congestion indicators with threshold values or calculate a probability that congestion information is available.

Exemplary embodiments also create a method for a transportation vehicle. The method comprises obtaining congestion indicators. The congestion indicators comprise at least one element of the group of speed of the transportation vehicle or of transportation vehicles in an area surrounding the transportation vehicle, and congestion warning. The method also comprises a determination of the congestion information based on the congestion indicators. The congestion information indicates whether the transportation vehicle is in a traffic jam. The method also comprises the provision of the traffic jam information to one or more transportation vehicles over a vehicle-to-vehicle communication link.

Exemplary embodiments also create a program with a program code for implementing the method if the program code is executed on a computer, a processor, a control module or a programmable hardware component.

Various exemplary embodiments will now be described in more detail with reference to the accompanying drawings, in which several exemplary embodiments are shown. In the figures, the thickness dimensions of lines, layers and/or regions are shown exaggerated for the sake of clarity.

In the following description of the attached figures, which only show some exemplary examples, the same reference numerals can be used to designate identical or equivalent components. In addition, collective reference numerals can be used for components and objects, which occur multiple times in at least one exemplary embodiment or in a drawing, but which are described together in relation to one or more features. Components or objects described with the same or collective reference numerals can be embodied in the same way in terms of individual, multiple or all features, for example, in terms of their dimensions, but may also be embodied differently, unless otherwise explicitly or implicitly given by the description.

Although exemplary embodiments can be modified and amended in different ways, the exemplary embodiments shown in the figures are examples and are described in detail herein. It should, however, be made clear that it is not intended to restrict exemplary embodiments to the disclosed forms, but that instead exemplary embodiments should cover functional and/or structural modifications, equivalents and alternatives which lie within the field of the disclosure. Identical reference numerals designate the same or similar elements throughout the description of the figures.

It is important to note that for any element, which is designated as being "connected" or "coupled" to any other element, it can either be directly connected or coupled to the other element or else intervening elements may be present. If on the other hand, an element is designated as being "directly connected" or "directly coupled" to another element, then there are no intervening elements present. Other terms used to describe the relationship between elements should be interpreted in a similar way (e.g., "between" compared to "directly between", "adjacent" compared to "directly adjacent", etc.).

The terminology used herein is used only for the description of certain exemplary embodiments and is not intended to restrict the exemplary embodiments. As used herein, the singular forms "a" and "an" and "the/this" are also meant to include the plural forms, unless the context clearly indicates otherwise. In addition, it should be clarified that the expressions such as "contains", "containing", "has", "comprises", "comprising" and/or "having" as used herein indicate the presence of cited features, whole numbers, operations, work processes, elements and/or components, but do not exclude the presence or addition of one more or one or a plurality of features, whole numbers, operations, work processes, elements, components and/or groups thereof.

Unless otherwise defined, all of the terms used herein (including technical and scientific terms) have the same meanings as would be ascribed to them by an average person skilled in the art in the field to which the exemplary embodiments belong. It should also be clarified that expressions, such as those that are defined in commonly used dictionaries, are to be interpreted, as if they had the meaning consistent with their meaning in the context of the relevant technology, and should not be interpreted in an idealized or overly formal sense, unless this is expressly defined herein.

For example, a local hazard detection can be improved through by the use of a transmitter and receiver principle. A transmitter (a moving transportation vehicle ahead) can be designed to detect whether it is located in a traffic jam, and to transmit this information to a receiver (a following transportation vehicle), which can process this information and, for example, display a warning. During the detection, the transmitter can be surrounded by stationary or crawling transportation vehicles, for example, on a highway or freeway. An ignition of the transmitter transportation vehicle is activated, for example, (or the terminal 15), and the transportation vehicle could be designed to detect that it is on a freeway, for example, by a speed profile, a digital map, or a camera). The trigger criteria for determining the traffic jam can be periodically or continuously updated or monitored.

FIG. 1 illustrates a block diagram of an exemplary embodiment of a device 10 for a transportation vehicle 100. The device 10 comprises a system 12 for obtaining congestion indicators. The congestion indicators comprise at least one element of the group of speed of the transportation vehicle 100 or of transportation vehicles in an area surrounding the transportation vehicle 100, and congestion warning. For example, the congestion indicators can be used to detect whether the transportation vehicle is located in a traffic jam. In this case the system 12 can comprise, for example, a sensor module or an interface, for example, to a sensor module, which determines, for example, a speed of the transportation vehicle. The system 12 can be designed, for example, to obtain the speed of the transportation vehicle 100 via a CAN bus of the transportation vehicle, or a sensor module of the device 12 can be designed to determine the speed of the transportation vehicle 100, for example, relative to a transport infrastructure, or based on a satellite navigation signal.

The speed of the transportation vehicles in an area surrounding the transportation vehicle 100 can also be detected, for example, by the system 12 via a sensor module, for example, via an optical or acoustic time-of-flight sensor, or via a video sensor. In this case the system 12 can access, for example, one or more sensors of the transportation vehicle, for example, parking sensors or sensors for an at least partial automation of the transportation vehicle (e.g., for adaptive cruise control, adaptive speed adjustment). The system 12 can be designed, for example, to process raw data from the sensors to determine the congestion indicators, for example, via an image analysis or a time-of-flight analysis.

Alternatively or additionally, the system 12 can be designed, for example, to obtain the speed of the transportation vehicles in an area surrounding the transportation vehicle via a vehicle-to-vehicle-interface 16. For example, the transportation vehicles in the environment can be designed to provide their speed to other transportation vehicles using periodic status messages. Cooperative Awareness Message (CAM) of a vehicle-to-vehicle standard are one example of an exemplary embodiment for such status messages, which the system 12 can obtain, for example, via the vehicle-to-vehicle interface 16.

The system 12 can obtain the congestion warning, for example, via a vehicle-to-infrastructure communication link, a vehicle-to-vehicle communication link, or using a mobile communication system, such as a Universal Mobile Telecommunication System (UMTS), a Long Term Evolution (LTE) mobile communication system or a 5th generation mobile communication system (5G). The traffic jam warning can correspond to a periodic or event-dependent message, which the system 12 can obtain, for example, from other transportation vehicles, from transport infrastructure or from a central system, such as a regional or global congestion detection system. The system 12 can be designed, for example, to obtain the congestion warning via a so-called Decentralized Environmental Notification Message (DENM), via the vehicle-to-vehicle interface 16, for example, from another transportation vehicle or from a transport infrastructure, such as a congestion reporting station on a freeway. In some exemplary embodiments, the congestion warning can correspond, for example, to traffic jam information of another transportation vehicle.

The device 10 also comprises a device 14 for determining congestion information based on the congestion indicators, wherein the congestion information indicates whether the transportation vehicle 100 is located in a traffic jam. The congestion information can correspond, for example, to a data packet or a data signal. For example, the data packet or the data signal can comprise the congestion information, for example, the congestion information can be a part of the data packet. In an exemplary embodiment, the congestion information can be one information item of a series of status information items of the transportation vehicle 100 in a status message, for example, one or more bits in a bit vector, wherein a 0 in the bit vector, for example, could mean that the transportation vehicle 100 is not in a traffic jam, and a 1 that the transportation vehicle is in a traffic jam. Furthermore, the data packet or the status information can comprise information about a confidence interval for the traffic jam information, for example, to indicate how reliable the system 14 assesses the congestion information. The system 14 can comprise, for example, a calculation module, or correspond to a calculation module, which calculates and codes the congestion information from the congestion indicators, and/or, for example, calculates a probability that the specific traffic jam information is true.

Congestion indicators which the system 14 has obtained via the system 12 and the vehicle-to-vehicle interface 16 (or via a sensor module), can be tested by the system, for example, for their relevance to the transportation vehicle 100. For example, the system 14 can check whether the direction of travel of another transportation vehicle, to which the indicator relates, matches the direction of travel of the transportation vehicle 100, whether a position of the other transportation vehicle is relevant (for example, on a digital map to interpret whether the additional transportation vehicle is located on a turn-off lane), or if a distance from the other transportation vehicle is too great.

Figure 2:
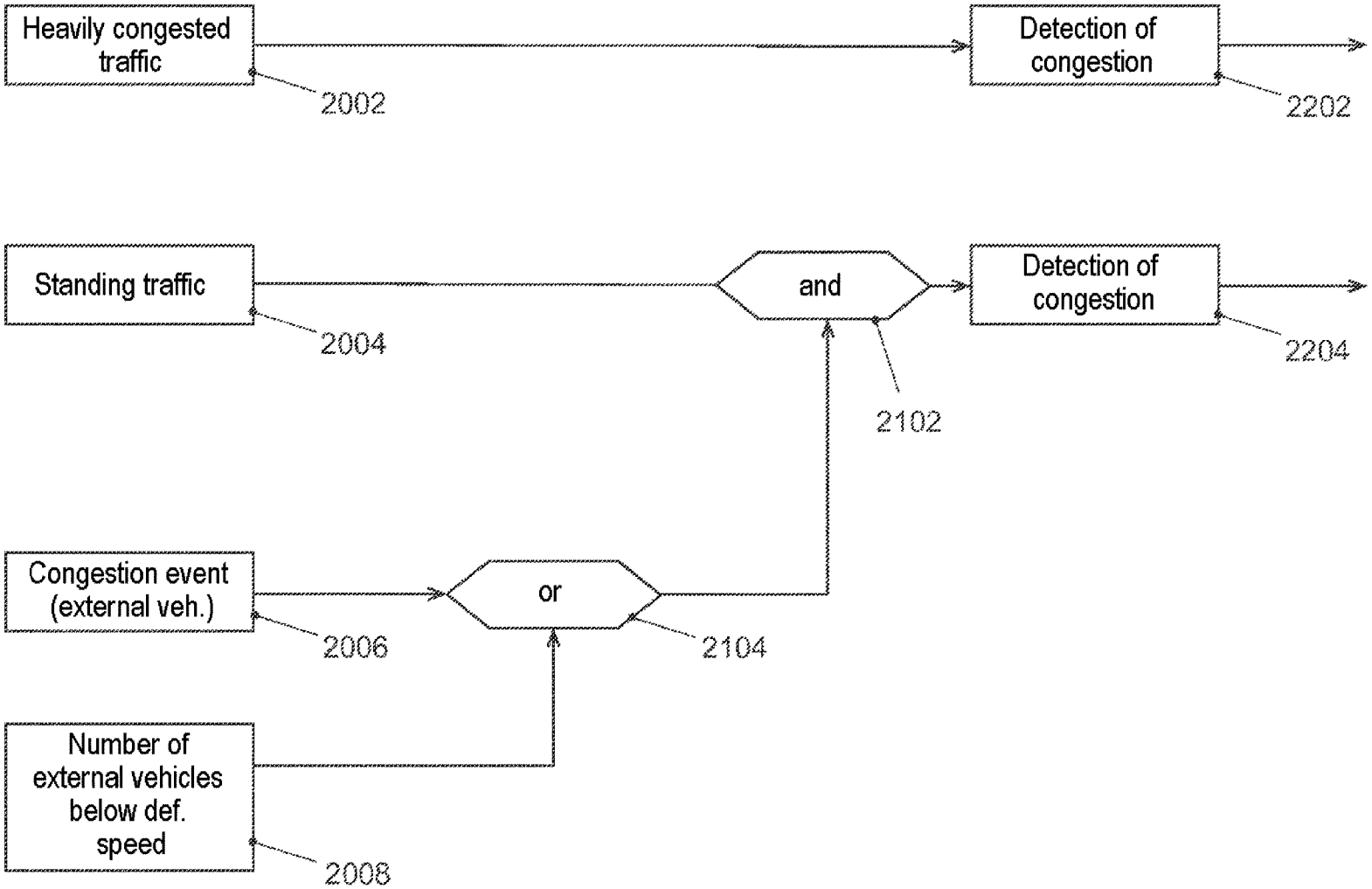
FIG. 2 shows an exemplary overview of possible combinations of congestion indicators for determining the congestion information.

FIG. 2 shows an exemplary overview of possible combinations of congestion indicators for determining the congestion information. FIG. 2 shows an example of the indicators for Heavily Congested traffic 2002, Standing Traffic 2004, a Congestion Event 2006 (such as a congestion warning), and the number of external transportation vehicles under a defined speed 2008. The congestion indicator for Heavily Congested Traffic 2002 can be calculated, for example, using the speed of the transportation vehicle 100. The system 14 can be designed, for example, to detect that the transportation vehicle 100 is in a traffic jam 2202, if an average speed of the transportation vehicle 100 during a measurement period is above a lower threshold value and below an upper threshold value. The duration of the measurement period can be, for example, between 60 s and 300 s, the lower threshold value between 3 and 10 km/h, and/or the upper threshold value between 20 and 40 km/h. In an exemplary embodiment, the system 14 might detect a traffic jam if the average speed of the transportation vehicle is between 3.6 km/h and 30 km/h over 120 s.

A further example possibility for detecting a traffic jam, is given by the congestion indicators 2004 to 2008. For example, the system 14 can be designed to detect that the transportation vehicle 100 is in a traffic jam 2204, if the transportation vehicle 100 is stationary during a measurement period, and another congestion indicator indicates a traffic jam. The congestion event 2006 and the number for the number of external transportation vehicles under the defined speed 2008 are examples of the additional congestion indicator. The system 16 can be designed, for example, to detect a traffic jam if the transportation vehicle is stationary and 2102 the transportation vehicle 100 has obtained a congestion event from another transportation vehicle, such as a congestion warning via the system 12, or 2014 if an average speed of transportation vehicles in an area surrounding the transportation vehicle 100 is below an upper threshold value 2008. The area surrounding the transportation vehicle can be, for example, 100 m and the system 14 can be designed to take into account only transportation vehicles that are travelling in the same direction. For example, the system 14 can be designed to obtain the average speed of the transportation vehicles in the surrounding area via a sensor module of the system 12, for example, via a time-of-flight sensor, or the system 14 can obtain the average speed, for example, using CAMs via the vehicle-to-vehicle interface 16. The congestion warning can be obtained by the system 14, for example, via a cellular radio connection or via a radio broadcast, for example, via a so-called Traffic Message Channel (TMC). The system 14 can alternatively or additionally be designed to obtain the congestion warning via the vehicle-to-vehicle interface 16, for example, via a DENM of another transportation vehicle or a transport infrastructure, such as a traffic flow sensor. The measurement period for the traffic jam indicator of Heavily Congested Traffic 2002 and Standing Traffic 2004 may be different. For example, the measurement period for the average speed of the transportation vehicle 100 for the indicator for Heavily Congested Traffic 2002 can be 120 s, and the measurement period for the indicator of Standing Traffic (the transportation vehicle 100 is stationary) can be 30 s.

The device 10 also comprises the vehicle-to-vehicle interface 16 designed to provide the traffic jam information to one or more other transportation vehicles 200 via a vehicle-to-vehicle communication link. The vehicle-to-vehicle communication link can be implemented, for example, by a shared communication channel (also shared channel, broadcast channel), and the vehicle-to-vehicle interface 16 can be designed to provide the congestion information to the other transportation vehicles 200 as a message to multiple recipients (also broadcast) via the vehicle-to-vehicle communication link. In some exemplary embodiments, the vehicle-to-vehicle communication link can be a direct communication link between two transportation vehicles, for example, without the use of a base station, for example, in accordance with IEEE 802.11p (a standard of the Institute of Electrical and Electronics Engineers).

In some exemplary embodiments, the vehicle-to-vehicle interface 16 can also be designed for vehicle-to-infrastructure communication. The system 14 can be designed, for example, to also provide the congestion information to a transport infrastructure over the vehicle-to-vehicle interface 16, for example, by a periodic status message, such as a CAM, or via an event-based message, such as a DENM.

The system 14 is designed in some exemplary embodiments to transfer the congestion information multiple times, for example, based on a (possibly standardized) refresh interval and based on a refresh period. For this, a time-out can be set not to overload the radio channel. The periodic status message can comprise, for example, a bit vector, which represents a status of the transportation vehicle, and the congestion information can be included, for example, in one or more bits of the bit vector. The periodic status messages can be sent, for example, with a refresh frequency of 1 to 10 repetitions per second. The event-based message (e.g., DENM) can also be repeated, and can include the congestion information and also, for example, a reason (for instance, the indicator) of the congestion information and a position of the transportation vehicle or the congestion. For example, the traffic jam information can be represented with the aid of a scale, for instance, between zero congestion via heavily congested traffic to standing traffic.

Figure 3:
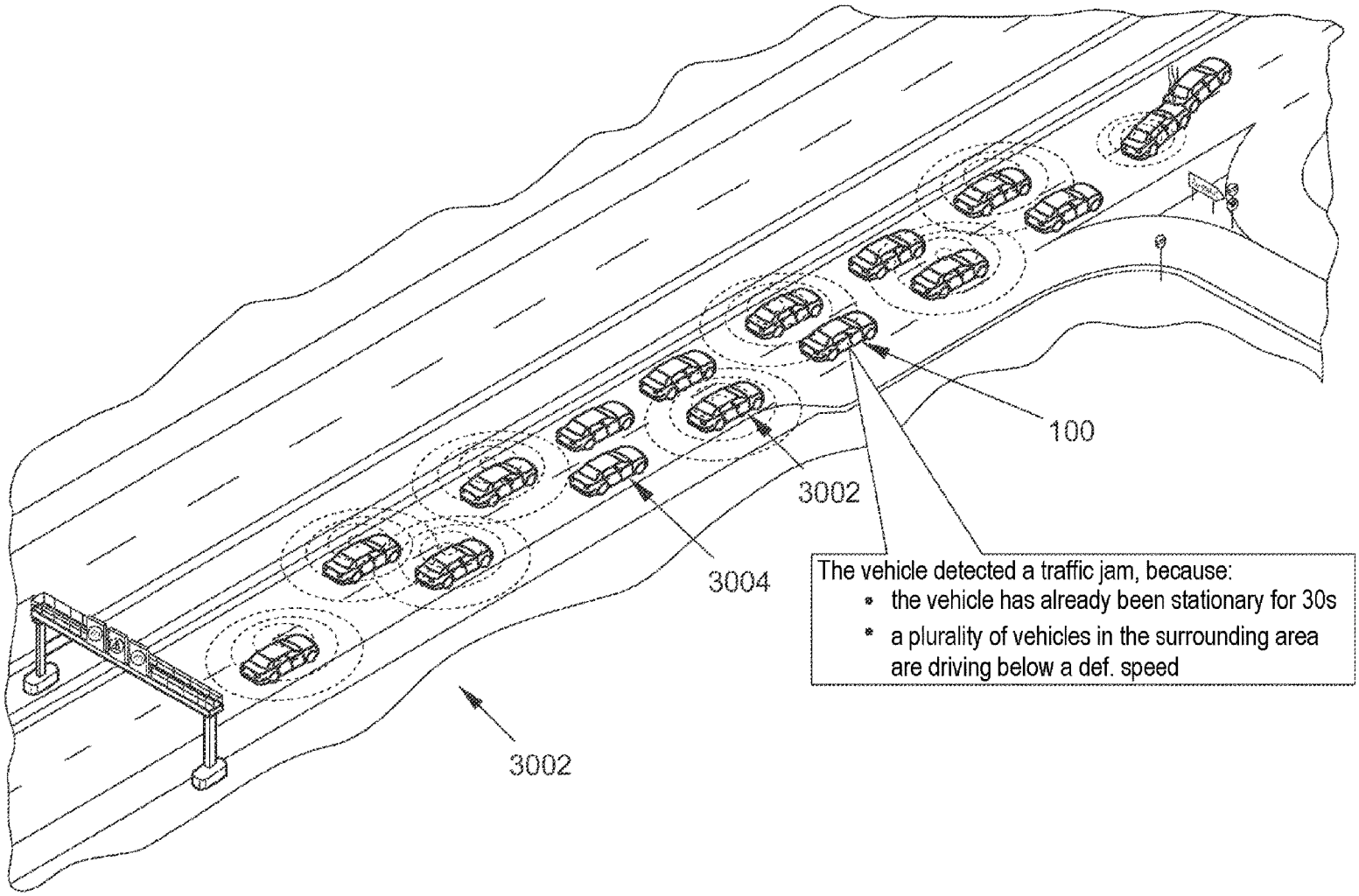
FIG. 3 shows one example of an exemplary embodiment.

FIG. 3 shows an exemplary embodiment, in which the transportation vehicle 100 is located in a traffic jam. The system 14 detects a jam due to the fact that the transportation vehicle is stationary for 30 s (Standing Traffic 2004) and a plurality of transportation vehicles in an area surrounding the transportation vehicle 100 are moving below a defined speed (indicator 2008). The system 14 is designed, for example, to detect the average speed of the transportation vehicles in the surrounding area via the vehicle-to-vehicle interface 16 (transportation vehicles 3002, detectable from the schematically illustrated radio signals) or via a sensor module (transportation vehicles without vehicle-to-vehicle interface 3004).

In exemplary embodiments, the system 12 and/or the system 14 can be any controller or processor or a programmable hardware component. For example, the system 12 and/or the system 14 can also be implemented as software which is programmed for a corresponding hardware component. In this respect, the system 12 and/or the system 14 can be implemented as programmable hardware with appropriately adapted software. Any type of processors, such as digital signal processors (DSPs) can be used for this.

Exemplary embodiments are not restricted to a specific type of processor. Any type of processors or else a plurality of processors can be used for implementing the system 12 and/or the system 14. The system 14 is coupled to the system 12 and the vehicle-to-vehicle interface 16.

In an exemplary embodiment, the vehicle-to-vehicle interface 16 corresponds to a direct vehicle-to-vehicle radio interface. The vehicle-to-vehicle interface 16 can be designed, for example, for a direct data communication with the one or more other transportation vehicles, for example, in accordance with IEEE 802.11p. The device 10 can exchange data messages, for example, with transportation vehicles in its surroundings via the vehicle-to-vehicle interface 16. The data messages can be transmitted periodically, for example, i.e. data are transmitted with a defined refresh frequency, for example, data on a status of the transportation vehicle, such as its speed, position, etc. Alternatively or additionally, the data messages can be transmitted on an event-driven basis, i.e. based on an event such as the detection of the end of a traffic jam or detection of a smooth road surface. Event-based data messages can also be repeated, for example, with a defined repetition period and repetition frequency, for example, to reach more receivers or to increase a probability of receipt of the data messages. The Cooperative Awareness Messages (periodic data messages sent by a transportation vehicle to make its presence known to other transportation vehicles) are an example of periodic data messages, and Decentralized Environmental Notification Messages (DENM) are an example of event-based data messages. These data messages can obtain, for example, current information about the transportation vehicle 100, for example, the position and the motion vector, but also, for example, sensor data, such as an acceleration, speed, or calculated information, such as the congestion information. In some exemplary embodiments, the vehicle-to-vehicle interface 16 can enable a transmission of data messages over a shared channel, and/or the vehicle-to-vehicle-interface 16 can enable a transmission of data messages without a multi-party connection structure, and/or the vehicle-to-vehicle interface 16 can be a distributed radio interface (or broadcast) for distributing data messages to a multiplicity of receivers. In some exemplary embodiments, the vehicle-to-vehicle interface 16 can communicate over frequencies in a 5.9 GHz frequency band (e.g., between 5.85 GHz and 5.925 GHz).

In at least some exemplary embodiments, a transportation vehicle, such as the transportation vehicle 100 or the one or more other transportation vehicles 200 can be, for example, an agricultural transportation vehicle, a road transportation vehicle, a car, an all-terrain transportation vehicle, a transportation vehicle, or a heavy goods transportation vehicle.

Figure 4:
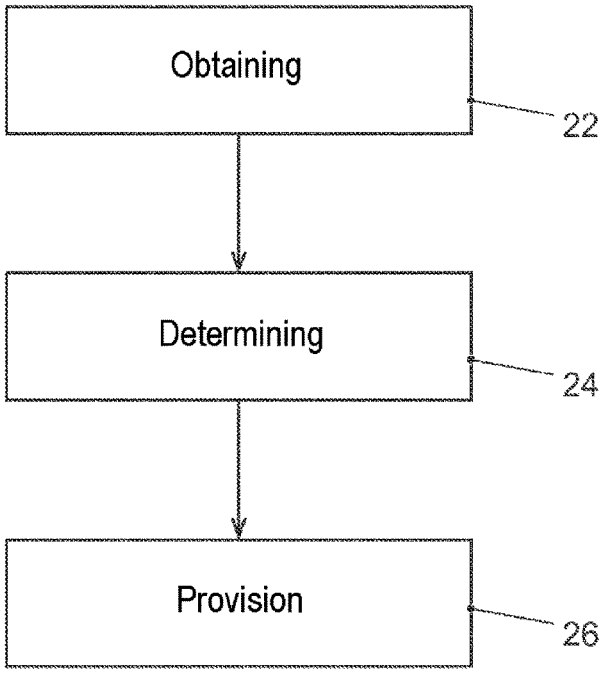
FIG. 4 illustrates a flow diagram of an exemplary embodiment of a device for a transportation vehicle for providing the congestion information.

FIG. 4 shows a flow diagram of a method for a transportation vehicle 100. The method comprises obtaining 22 congestion indicators. The congestion indicators comprise at least one element of the group of speed of the transportation vehicle 100 or of transportation vehicles in an area surrounding the transportation vehicle 100, and congestion warning. The method also comprises a determination 24 of congestion information based on the congestion indicators. The congestion information indicates whether the transportation vehicle 100 is located in a traffic jam. The method also comprises the provision 26 of the traffic jam information to one or more other transportation vehicles 200 via a vehicle-to-vehicle communication link.

Exemplary embodiments also create a transportation vehicle (100) comprising the device (10).

Another exemplary embodiment is a computer program for implementing the method when the computer program is executed on a computer, a processor or a programmable hardware component. Another exemplary embodiment is also a digital storage medium, which is machine- or computer-readable, and has electronically readable control signals, which can interact with a programmable hardware component such that one of the methods described above is executed.

The features disclosed in the present description, the claims and the drawings can be of significance and implemented both individually as well as in any desired combination to realize an exemplary embodiment in its various configurations.

Depending on the specific implementation requirements, exemplary embodiments can be implemented either in hardware or in software. The implementation can be carried out by using a digital storage medium, such as a floppy disk, a DVD, a Blu-Ray disc, a CD, a ROM, a PROM, or an EPROM, EEPROM or Flash memory, a hard disk or other magnetic or optical storage, on which electronically readable control signals are stored, which can interact with a programmable hardware component, or interact in such a way that the respective method is carried out.

A programmable hardware component can be formed by a processor, a computer processor (CPU=Central Processing Unit), a graphics processing unit (GPU), a computer, a computer system, an application-specific integrated circuit (ASIC), an integrated circuit (IC), a single-chip system (SOC=System-on-Chip), a programmable logic element or a field-programmable gate array (FPGA) with a microprocessor.

The digital storage medium can therefore be machine- or computer-readable. Some exemplary embodiments thus comprise a data carrier, which has electronically readable control signals that are capable of interacting with a programmable computer system or a programmable hardware component, in such a way that one of the methods described herein is carried out. At least one exemplary embodiment, therefore, is a data carrier (or a digital storage medium or a computer-readable medium), on which the program is recorded for carrying out one of the methods described herein.

In general, exemplary embodiments can be implemented as software, firmware, computer program or computer program product with a program code or as data, wherein the program code is, or the data are, effective in terms of carrying out one of the methods if the program is running on a processor or a programmable hardware component. The program code or the data can also be stored, for example, on a machine-readable medium or data carrier. The program code or the data can exist as source code, machine code or byte code, among other things, as well as other intermediate code.

A program in accordance with at least one exemplary embodiment can implement one of the methods during its implementation, for example, by the program reading out memory locations or writing a datum or plurality of data into these locations, which enables switching operations or other operations to be invoked in transistor structures, in amplifier structures or in other electrical, optical, magnetic components or components operating according to another functional principle. Accordingly, by reading from a memory location, data, values, sensor values or other information can be recorded, determined or measured by a program. By reading out one or more memory locations, a program can therefore detect, determine or measure variables, values, measurement variables and other information, and by writing to one or more memory locations can also perform, initiate or implement an action, and also control other equipment, machinery and components.

The examples described above only represent an illustration of the principles. It is implicit that modifications and variations of the arrangements and details described herein will be apparent to other persons skilled in the art. It is therefore intended that the disclosure be limited only by the scope of protection of the following patent claims and not by the specific details which have been presented herein on the basis of the description and explanation of the exemplary embodiments.

LIST OF REFERENCE NUMERALS

10 device
12 system
14 system
16 vehicle-to-vehicle interface
22 obtaining
24 determination
26 provision
100 transportation vehicle
2002 heavily congested traffic
2004 standing traffic
2006 congestion event
2008 number of foreign transportation vehicles below def. speed
2102 and
2104 or
2202 detection of congestion
2204 detection of congestion
3002 transportation vehicles with vehicle-to-vehicle interface
3004 transportation vehicles without vehicle-to-vehicle interface

The invention claimed is:

1. A device for a transportation vehicle, the device comprising:

a system for obtaining traffic jam indicator data, wherein the traffic jam indicator data comprise at least one of speed of the transportation vehicle, speed of transportation vehicles in an area surrounding the transportation vehicle, and a traffic jam warning;

a device for determining traffic jam information based on the traffic jam indicator data, wherein the traffic jam information indicates whether the transportation vehicle is located in a traffic jam, wherein the device for determining traffic jam information includes a calculation module configured to calculate a probability that the determined traffic jam information is accurate by comparing traffic jam indicators with threshold values or calculate a probability that traffic jam information is available; and a vehicle-to-vehicle interface to provide the traffic jam information to one or more other transportation vehicles via a vehicle-to-vehicle communication link subsequent to the calculation module determining that the traffic jam information is accurate.

2. The device of claim 1, wherein the system obtains the traffic jam warning via a vehicle-to-infrastructure communication link, a vehicle-to-vehicle communication link, or via a mobile communication system included in the transportation vehicle.

3. The device of claim 2, wherein the system obtains the traffic jam warning via a Decentralized Environmental Notification Message via the vehicle-to-vehicle interface of the transportation vehicle.

4. The device of claim 1, wherein the system obtains the speed of the transportation vehicles in the area surrounding the transportation vehicle via a video sensor or a time-of-flight sensor coupled to and part of the transportation vehicle, and/or wherein the system obtains the speed of the transportation vehicles in the area surrounding the transportation vehicle via the vehicle-to-vehicle interface of the transportation vehicle.

5. The device of claim 4, wherein the system obtains the speed of the transportation vehicles in the area surrounding the transportation vehicle via Cooperative Awareness Messages over the vehicle-to-vehicle interface of the transportation vehicle.

6. The device of claim 1, wherein the system detects that the transportation vehicle is in a traffic jam in response to an average speed of the transportation vehicle during a measurement period being above a lower threshold and below an upper threshold value.

7. The device of claim 1, wherein the system detects that the transportation vehicle is in a traffic jam in response to the transportation vehicle being stopped during a measurement period, and another traffic jam indicator indicating a traffic jam.

8. The device of claim 7, wherein the system detects that the transportation vehicle is in a traffic jam in response to:

the transportation vehicle being stopped during a measurement period, and the system obtaining a traffic jam warning via the system and/or an average speed of transportation vehicles in an area surrounding the transportation vehicle being below an upper threshold value.

9. The device of claim 8, wherein the measurement period has a duration of between 60 s and 300 s, and/or the lower threshold value is between 3 and 10 km/h, and/or the upper threshold value is between 20 and 40 km/h.

10. The device of claim 1, wherein the vehicle-to-vehicle interface is designed for vehicle-to-infrastructure communication.

11. The device of claim 1, wherein the system provides the traffic jam information to a transport infrastructure via the vehicle-to-vehicle interface.

12. The device of claim 1, wherein the system provides the traffic jam information as a Cooperative Awareness Message via the vehicle-to-vehicle interface.

13. The device of claim 1, wherein the system comprises a sensor module and/or an input interface for producing traffic jam indicator data.

14. A method for determining traffic jam information for a transportation vehicle, the method comprising:

obtaining traffic jam indicator data, wherein the traffic jam indicator data comprise at least one of speed of the transportation vehicle, speed of transportation vehicles in an area surrounding the transportation vehicle, and a traffic jam warning;

determining traffic jam information based on the traffic jam indicator data, wherein the traffic jam information indicates whether the transportation vehicle is located in a traffic jam, wherein the determining traffic jam information includes calculating a probability that the determined traffic jam information is accurate by comparing traffic jam indicators with threshold values or calculate a probability that traffic jam information is available; and providing the traffic jam information to one or more transportation vehicles via a vehicle-to-vehicle communication link subsequent to the calculation module determining that the traffic jam information is accurate.

15. A non-transitory computer readable medium including a program with a program code for implementing a method when the program code is executed on a computer, a processor, a control module or a programmable hardware component, the method comprising:

obtaining traffic jam indicator data, wherein the traffic jam indicator data comprise at least one of speed of a transportation vehicle, speed of transportation vehicles in an area surrounding the transportation vehicle, and a traffic jam warning;

determining traffic jam information based on the traffic jam indicator data, wherein the traffic jam information indicates whether the transportation vehicle is located in a traffic jam, wherein the determining traffic jam information includes calculating a probability that the determined traffic jam information is accurate by comparing traffic jam indicators with threshold values or calculate a probability that traffic jam information is available; and providing the traffic jam information to one or more transportation vehicles via a vehicle-to-vehicle communication link subsequent to the calculation module determining that the traffic jam information is accurate.

16. The device of claim 13, wherein the system obtains the traffic jam warning via:

a vehicle-to-infrastructure communication link, a vehicle-to-vehicle communication link, or via a mobile communication system included in the transportation vehicle.

17. The device of claim 16, wherein the system obtains the traffic jam warning via a Decentralized Environmental Notification Message via the vehicle-to-vehicle interface of the transportation vehicle.

18. The device of claim 13, wherein the system obtains the speed of the transportation vehicles in the area surrounding the transportation vehicle via a video sensor or a time-of-flight sensor coupled to and part of the transportation vehicle, and/or wherein the system obtains the speed of the transportation vehicles in the area surrounding the transportation vehicle via the vehicle-to-vehicle interface of the transportation vehicle.

19. The device of claim 18, wherein the system obtains the speed of the transportation vehicles in the area surrounding the transportation vehicle via Cooperative Awareness Messages over the vehicle-to-vehicle interface of the transportation vehicle.

20. The method of claim 14, further comprising detecting that the transportation vehicle is in a traffic jam in response to an average speed of the transportation vehicle during a measurement period being above a lower threshold and below an upper threshold value.

21. The method of claim 14, further comprising detecting that the transportation vehicle is in a traffic jam in response to the transportation vehicle being stopped during a measurement period, and another traffic jam indicator indicating a traffic jam.

22. The method of claim 21, further comprising detecting that the transportation vehicle is in a traffic jam in response to:

the transportation vehicle being stopped during a measurement period, and the system obtaining a traffic jam warning via the system and/or an average speed of transportation vehicles in an area surrounding the transportation vehicle being below an upper threshold value.

23. The method of claim 22, wherein the measurement period has a duration of between 60 s and 300 s, and/or the lower threshold value is between 3 and 10 km/h, and/or the upper threshold value is between 20 and 40 km/h.

24. The method of claim 14, wherein the vehicle-to-vehicle communication link is designed for vehicle-to-infrastructure communication.

25. The method of claim 14, further comprising providing the traffic jam information to a transport infrastructure via the vehicle-to-vehicle communication link or as a Cooperative Awareness Message via the vehicle-to-vehicle communication link.

26. The method of claim 14, further comprising producing traffic jam indicator data using a sensor module and/or an input interface included in the transportation vehicle.

27. The non-transitory computer readable medium of claim 15, wherein the method further comprises detecting that the transportation vehicle is in a traffic jam in response to an average speed of the transportation vehicle during a measurement period being above a lower threshold and below an upper threshold value.

28. The non-transitory computer readable medium of claim 15, wherein the method further comprises detecting that the transportation vehicle is in a traffic jam in response to the transportation vehicle being stopped during a measurement period, and another traffic jam indicator indicating a traffic jam.

29. The non-transitory computer readable medium of claim 28, wherein the method further comprises detecting that the transportation vehicle is in a traffic jam in response to:

the transportation vehicle being stopped during a measurement period, and the system obtaining a traffic jam warning via the system and/or an average speed of transportation vehicles in an area surrounding the transportation vehicle being below an upper threshold value.

30. The non-transitory computer readable medium of claim 29, wherein the measurement period has a duration of between 60 s and 300 s, and/or the lower threshold value is between 3 and 10 km/h, and/or the upper threshold value is between 20 and 40 km/h.

31. The non-transitory computer readable medium of claim 15, wherein the vehicle-to-vehicle communication link is designed for vehicle-to-infrastructure communication.

32. The non-transitory computer readable medium of claim 15, wherein the method further comprises providing the traffic jam information to a transport infrastructure via the vehicle-to-vehicle communication link or as a Cooperative Awareness Message via the vehicle-to-vehicle communication link.

33. The non-transitory computer readable medium of claim 15, wherein the method further comprises producing traffic jam indicator data using a sensor module and/or an input interface included in the transportation vehicle.

* * * * *